US008240267B2

(12) United States Patent
Durand et al.

(10) Patent No.: US 8,240,267 B2
(45) Date of Patent: Aug. 14, 2012

(54) SCALE TURNING DEVICE, NOTABLY FOR STREAMLINED TRACTOR ROPE COMPRISING SUCH SCALES

(75) Inventors: Dominique Durand, Pleumeur Bodou (FR); Olivier Jezequel, Saint Thonan (FR)

(73) Assignee: Thales (FR)

( * ) Notice: Subject to any disclaimer, the term of this patent is extended or adjusted under 35 U.S.C. 154(b) by 173 days.

(21) Appl. No.: 12/741,823

(22) PCT Filed: Nov. 6, 2008

(86) PCT No.: PCT/EP2008/065049

§ 371 (c)(1), (2), (4) Date: May 6, 2010

(87) PCT Pub. No.: WO2009/060025

PCT Pub. Date: May 14, 2009

(65) Prior Publication Data

US 2010/0236465 A1 Sep. 23, 2010

(30) Foreign Application Priority Data

Nov. 9, 2007 (FR) ..... 07 07860

(51) Int. Cl.
*B63B 21/66* (2006.01)

(52) U.S. Cl. ..... 114/243

(58) Field of Classification Search ..... 114/243, 114/244, 245, 254

See application file for complete search history.

(56) References Cited

U.S. PATENT DOCUMENTS

| | | | | |
|---|---|---|---|---|
| 2,401,783 | A | 6/1946 | Wilcoxon | |
| 3,379,162 | A * | 4/1968 | Eller et al. | 114/243 |
| 3,987,745 | A | 10/1976 | Chaverebiere de Sal et al. | |
| 4,836,122 | A | 6/1989 | Henderson et al. | |
| 5,000,110 | A * | 3/1991 | Moore | 114/245 |

FOREIGN PATENT DOCUMENTS

GB 1 261 969 2/1972

* cited by examiner

*Primary Examiner* — Lars A Olson
(74) *Attorney, Agent, or Firm* — Baker & Hostetler, LLP

(57) ABSTRACT

The present invention relates to a means for mutually aligning the scales of a rope streamlined by means of scales articulated to rotate about its axis, the alignment being necessary to enable such a rope to be wound onto the drum of a winch. It mainly consists of a device presenting a bevelled front face and comprising a cavity extending from front to rear, inside which passes the rope before it is wound. The cavity presents a longitudinal opening with two lateral edges, each edge following, from front to back, a profile in helical form, the two helices being coaxial to each other and with the axis of symmetry of the cavity. The wall of the cavity is also configured so as to follow the cross-sectional profile of the scale all along its path in the device. The device is arranged relative to the drum on which the rope is wound so that, given the length of the edges of the opening, regardless of the orientation of a scale on entering the device, the latter, on exiting, assumes the desired orientation, in the alignment of the adjacent scales. The invention applies notably to the systems for handling tractor ropes streamlined by means of scales, used on a ship to pull a submersible body cast off at sea.

12 Claims, 6 Drawing Sheets

SCALE TURNING DEVICE, NOTABLY FOR STREAMLINED TRACTOR ROPE COMPRISING SUCH SCALES

CROSS-REFERENCE TO RELATED APPLICATIONS

This application is a National Stage of International patent application PCT/EP2008/065049, filed on Nov. 6, 2008, which claims priority to foreign French patent application No. FR 07 07860, filed on Nov. 9, 2007, the disclosures of which are incorporated by reference in their entirety.

FIELD OF THE INVENTION

The present invention relates to the streamlined tractor ropes used on a ship to pull a submersible body cast off at sea and the systems for hauling the latter onboard and stowing same, on the drum of a winch for example. It more particularly relates to the tractor ropes streamlined by means of articulated scales.

BACKGROUND OF THE INVENTION

The context of the invention is that of a naval vessel intended to deploy a towed submersible object. In such a context, in the non-operational phase, the submersible body is stored onboard the vessel and the tractor or towing rope is wound on the drum of a winch. Conversely, in the operational phase, the submersible body is submerged behind the boat and pulled by the latter by means of the tractor rope, the rope itself being immersed apart from the end that remains linked to the winch.

In such a context, it is useful to reduce the drag of the tractor rope when the latter is immersed. To do this, it is known to use a streamlined rope and in particular a rope streamlined by means of fairings, or scales, such as that illustrated by FIG. 1. This scale comprises an elongate element, hydrodynamic, for example, in the form of a fin, presenting on a thick internal edge a tubular duct into which passes the rope and a thin external edge allowing a less turbulent flow of the water about the rope. The set of scales totally or partially covers the rope.

In normal operation, the scales are mounted to move about the rope and joined to rotate relative to each other. This way, the rotation of one scale leads to a rotation of the adjacent scales and, step by step, of all of the scales.

This means that, both when the rope is deployed in the water and when it is wound on the drum, the scales are all oriented in the same way and any change of orientation of one of the scales will bit by bit affect all the scales streamlining the rope. Thus, when the rope is deployed at sea, the scales are naturally oriented in the direction of the current generated by the pulling force exerted by the movement of the vessel. In the same way, when the rope is wound onto the drum of the winch, as the rope rises, all the scales adopt one and the same orientation relative to the drum, as illustrated by FIG. 2, an orientation that makes it possible to wind the rope by maintaining the scales parallel to each other turn-by-turn.

However, it is often the case that, during the life of the rope, the link between certain scales is broken and that one or more scales is/are partially damaged. In this case, with the link between scales being broken in certain places, it is possible that one or more scales will no longer be aligned with the whole. It is then in particular possible that, when the rope is wound onto the drum of the winch, one or more scales will be badly oriented relative to the drum and that they will then not adopt a position conforming to the arrangement presented in FIG. 2, an arrangement in which all the scales situated at the same level on the drum are parallel to each other. One or more scales can thus, for example, be lying down in a configuration such as that illustrated by FIG. 4. The consequence of such a positioning is to hamper the winding of the tractor rope and often, as illustrated by the figure, to lead to the breaking of the badly-positioned scale.

SUMMARY OF THE INVENTION

One aim of the invention is to propose a solution to ensure a correct positioning and alignment, according to a given orientation, of the scales that streamline a rope, in particular a tractor rope, so as to enable it to be automatically wound onto the drum of a winch without risk of damaging the scales and this regardless of the state of integrity of these scales, in particular the state of integrity of the means that joins each scale to its neighbours rotation-wise.

To this end, the subject of the invention is a device for ensuring the orientation in a fixed direction of an object threaded on a rope, moving rotation-wise about said rope and joined to said rope translation-wise, said object having the form of a cylinder of length L, presenting a transversal section of height H and comprising a longitudinal duct having the form of a cylinder of revolution, located at the level of its widest base, by which it is threaded onto the rope. The device according to the invention is characterized in that it comprises a rear face through which leaves the rope, a bevelled front face, through which enters the rope, and a cavity of a length at least equal to the length of the object to be oriented. Said cavity presents an axis of symmetry and comprises an opening extending over its entire length, the edge of which is formed by two symmetrical half-edges, the profiles of which firstly follow two counter-rotational and coaxial helical curves, the axis of symmetry of which is the same as the axis of symmetry of the cavity. Each helical half-edge performs a rotation of around 180° about the axis of symmetry from a point of the edge of the opening common to both half-edges and situated at the level of the front face of the device. The profiles of the half-edges then follow two parallel straight segments spaced apart so that the width of the opening ensures the appropriately oriented guidance of the object until the device is paid out by maintaining the desired orientation.

In one particular embodiment of the device according to the invention, the cavity presents a wall constructed by effecting an excavation of the material forming the device along an axis that is the same as the axis of symmetry of the cavity, the excavation being done by a sweep of the section of the device by a surface corresponding to the section, in transverse cross-section, of the object, the angular opening of the sweep being defined, for the section passing through a given transverse plane, by the intersections of the half-edges with this plane.

In a particular embodiment, that can be associated with the preceding one, the device according to the invention also comprises a fixing arm making it possible to position it so as to ensure the desired orientation of the object to be oriented after its passage into the device.

According to a variant of the preceding embodiment, the fixing arm is configured to enable the movement rotation-wise in a horizontal plane of the device.

According to another variant that can be combined with the preceding one, the fixing arm forms an elastic plate making it possible to control the pressure force exerted on the rope on its passage into the device.

In an embodiment, that can be combined with the preceding ones, the device according to the invention comprises means for imposing, on the object to be oriented, an input orientation avoiding contact of the object with the point of the front face of the device.

In an embodiment, that can be combined with the preceding ones, the device according to the invention also comprises means for positioning the axis of the rope along the axis of symmetry of the cavity.

According to a variant of this embodiment, the means for positioning the axis of the rope comprise a grooved rolling bearing arranged at the rear of the bevelled front face.

In an embodiment, that can be combined with the preceding ones, the device according to the invention also comprises means for limiting the pressure force exerted on the rope on its passage into the device, these means being placed at the level of the area where the rope comes into contact with the wall of the cavity.

Another subject of the invention is an application of the device to the turning of the scales forming the streamlining of a rope for pulling a submersible body by a ship, said device being implemented to ensure the automatic orientation of the scales of the rope in an orientation allowing the rope to be wound onto the drum of a winch.

Another subject of the invention is a distribution system for a rope for pulling a submersible body by a ship, comprising a scale turning device as described above, mounted at the head of the system via the fixing arm.

Another subject of the invention is a variant of the preceding distribution system, in which the turning device is fixed to the system by means enabling the device to rotate in a vertical plane.

Advantageously, the device according to the invention can be developed for scales or various and more or less complex forms built on the model of a cylinder whose transverse cross section presents a thin and more or less hydrodynamic profile.

BRIEF DESCRIPTION OF THE DRAWINGS

The characteristics and advantages of the invention will be better appreciated from the description that follows, a description that explains the invention through a particular embodiment taken as a non-limiting example and which is based on the appended figures, which represent.

DETAILED DESCRIPTION

Interest is first of all focussed on FIGS. 1 to 4 which clearly illustrate the technical problem resolved by the invention. This illustration is given through the particular example of an electric tractor rope intended to provide the link between a submersible body and the ship transporting it, when the submersible body is immersed in the wake of the ship.

Figure 1:
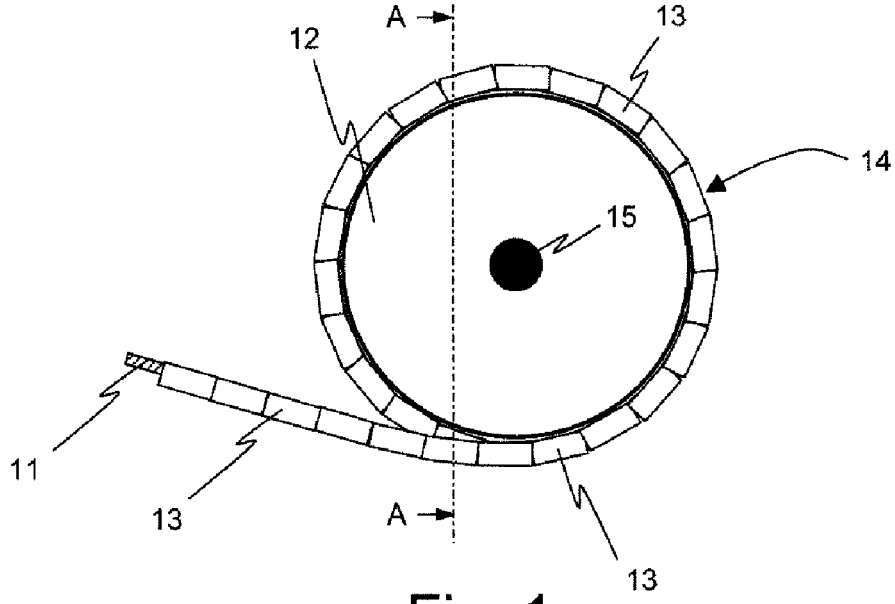
FIGS. 1 to 4, illustrations relating to the problem posed by the automatic winding of a scaled rope onto a winch.

As illustrated by FIG. 1, the handling, in other words the casting off and recovery of the immersed body (not represented in the figure) is performed by means of a tractor rope 11 wound at rest on the drum 12 of a winch. When the submersible body is operational, that is, when it is immersed being towed by the ship, the tractor rope 11 is paid out from the drum to a certain length, so as to enable the positioning of the submersible body at a certain depth and at a certain distance from the ship, and to enable it to be towed. In this situation, the rope is itself immersed over all or part of its length so that it produces in its wake a water drag generating turbulences, and efforts are made to limit the drag by equipping the rope with fairings 13, also called scales.

A scale 13 appears as an elongate element, relatively flat, having the general appearance of a dorsal fin. The scales are arranged on the rope so as to form a continuous, or discontinuous, sheathing, and articulated and moving rotation-wise about the rope. They can also, as illustrated by the cross-sectional view of FIG. 2, be linked to each other to rotate about the axis of the rope so as to present a substantially continuous edge 14 along the axis of the rope.

Figure 2:
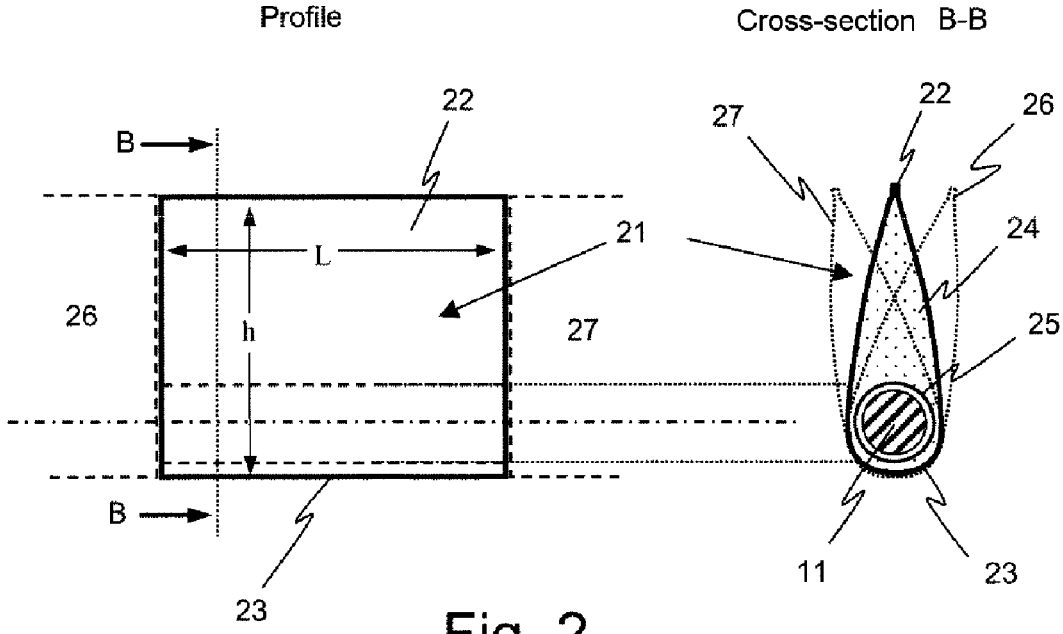

This dual mobility enables both each scale 13 to follow the movements of the rope 11 in the water, movements due, for example, to the changes of heading of the pulling ship, and adopt an orientation enabling it to oppose the weakest resistance to the current provoked by the displacement of the rope in the water. The axial link that exists between each scale and its neighbours also makes it possible to limit the difference (the deviation) that can exist between a scale 13 and the scales 131 and 132 immediately adjacent, while allowing a certain deviation, as illustrated by FIG. 2. This way, when a rotation movement about the rope is imparted on a scale 13, the latter takes with it in its movement the adjacent scales 131 and 132. Consequently, a high-amplitude orientation movement can be imparted on all of the sheathing formed by the juxtaposition of the scales along the rope. The duly-constituted sheathing therefore presents the appearance of a succession of fin segments, each oriented so that the sheathing presents overall the weakest possible drag given the movements imparted on the rope.

In the exemplary embodiment described here, the role of the sheathing formed by the scales 13 is to reduce the wake turbulences produced by the movement of the rope in the water, when the latter is dropped into the water and pulled by the ship. Consequently, its component scales assume a specific form which confers on them a hydrodynamic nature such as that represented in FIG. 2. From a general descriptive point of view, each scale appears as a cylindrical object 21 of length L, of which the base section, the section 24, substantially describes a symmetrical NACA profile presenting a thin edge 22 and a wide edge 23. The cylinder 21 described in this way comprises in its thickest part 23 a longitudinal duct 25 in the form of a cylinder of revolution, the diameter of which is substantially equal to that of the rope 11. The link means between the immediately adjacent scales 26 and 27, means not represented in FIG. 2, are, moreover, located at the level of the ends of the duct 25.

From a more general point of view, the device according to the invention can be configured to be adapted to various forms of scales, provided that the latter appear as a cylindrical object 21 of length L, of height h and comprising on one of its edges a longitudinal duct 25 in the form of a cylinder of revolution, the diameter of which is substantially equal to that of the rope. This object can, for example, be a rectangular parallelepipedal of length L and of section s that is sufficient to house the longitudinal duct 25 on one of the edges of the parallelepipedal. The axis of the longitudinal duct is here parallel to the longitudinal axis passing through the centre of symmetry of the scale and distant from the latter.

Figure 3:
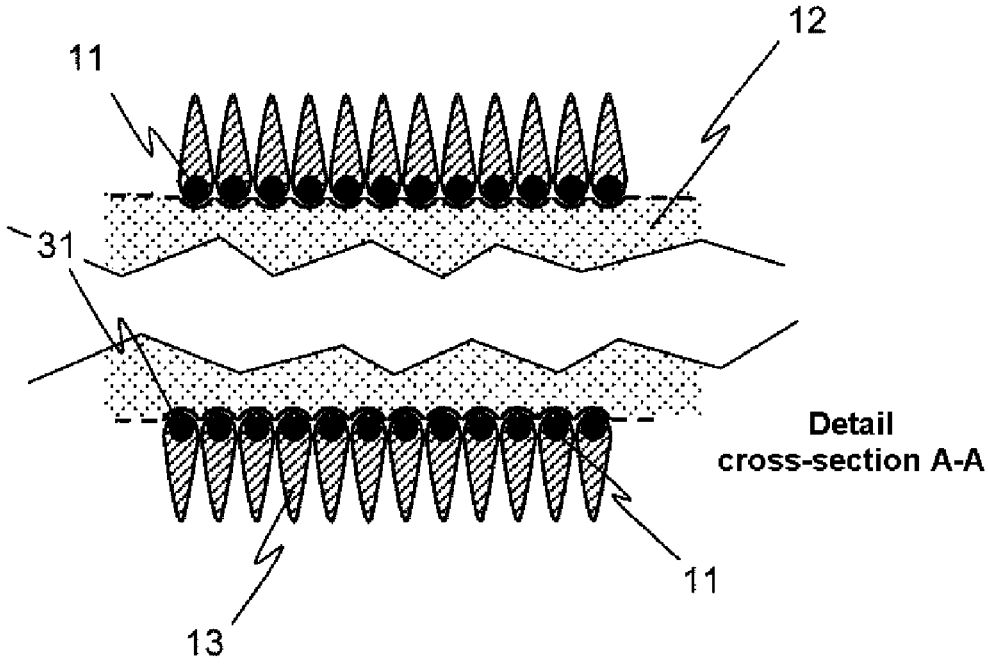
Figure 4:
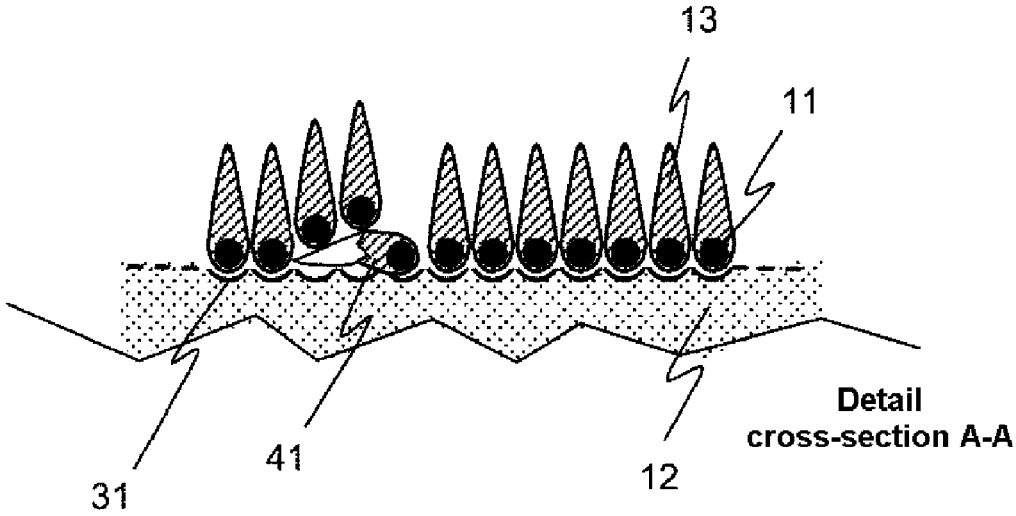

When the submersible body is not deployed at sea, it is installed on the supporting ship while the tractor rope is wound onto the drum 12 of the winch used to manoeuvre it. To facilitate the correct automatic positioning of the rope on the surface of the winch as it is wound on, the surface of the drum can, for example, comprise, as illustrated by FIG. 3, a helical grooving 31 in the turns of which the rope 11 is positioned.

Thus, in as much as the correct initial orientation of the rope with respect to the drum of the winch is assured, an orientation for which the free edges of the scales are not in contact with the drum, and because the scales are linked to each other, the distribution is, in normal circumstances, advantageously facilitated. After winding, the tractor rope is thus, as illustrated by FIG. 3, correctly positioned on the drum, that is, with its scales oriented substantially perpendicularly. There is therefore no risk of damage to the scales which are intrinsically relatively fragile.

On the other hand, if one or more scales have been damaged during the phase of implementation of the submersible body, during which the rope is deployed at sea, and if the damage undergone affects their link with the adjacent scales, a correct initial positioning of the rope is not sufficient to guarantee that the complete automatic winding of the rope onto the drum of the winch will proceed correctly. Situations of the type of that illustrated by FIG. 4 may then be encountered, in which a scale 41 which is free to rotate with respect to its neighbours, because of the breaking of the means (an axial guide with end-stops for example) which provide this link, is positioned flat on the drum, so that on subsequent turns it is flattened by the rope and generally broken. In the absence of additional means, the only way of avoiding such a consequence is to manually check the state of the scales while the rope is being wound and manually position the scales that have become separated from their neighbours. Such an intervention has the major drawback of making the winding operation lengthy and, above all, not very automatic.

Figure 5:
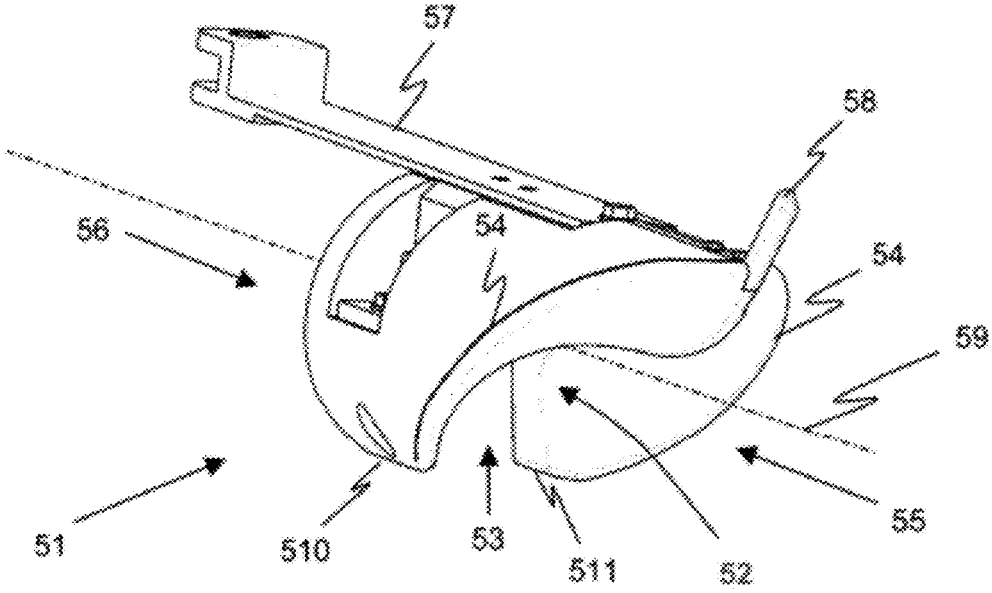
FIGS. 5 and 6 and 7, overall views of the device according to the invention, in a version adapted to the automatic winding of a scaled rope onto a winch.
Figure 6:
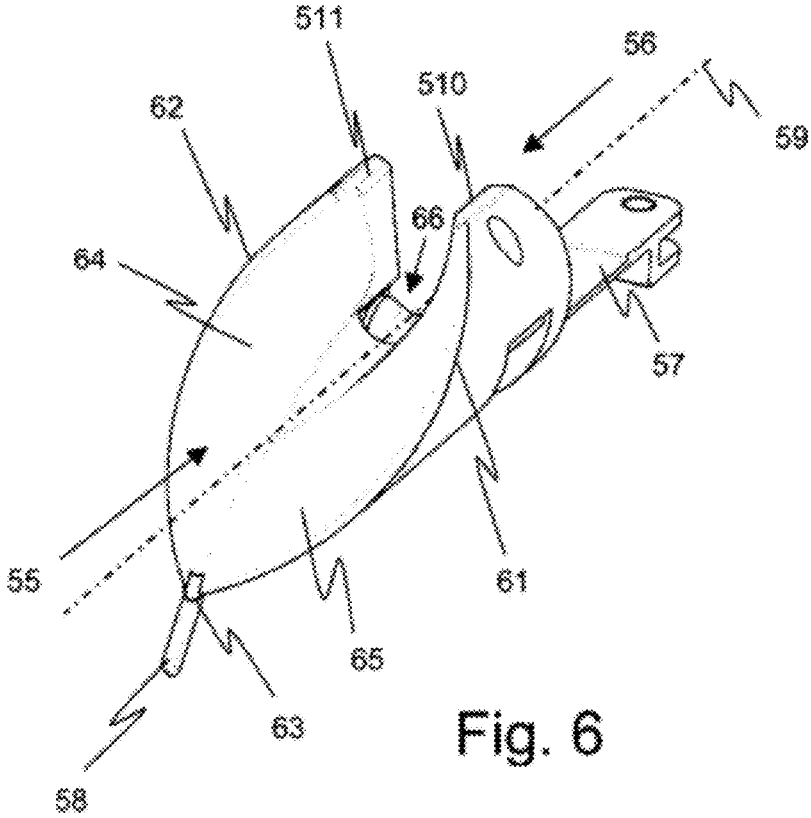
Figure 7:
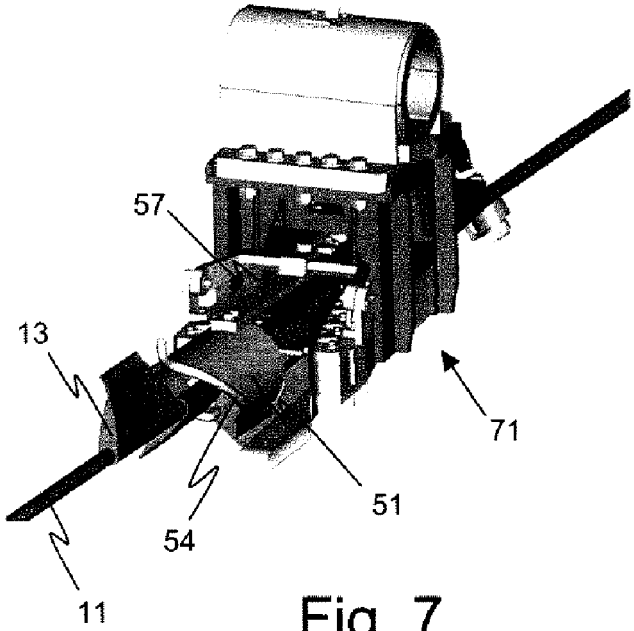

Consideration is now given to FIGS. 5 to 7 which overall show the device according to the invention.

FIG. 5 proposes a global representation of the device in its normal orientation. As can be seen in this figure, the device according to the invention takes the form of a solid object 51 comprising a cavity 52 presenting an axis of symmetry of revolution indicated by the broken line 59 in the figure. This cavity itself presents a longitudinal opening 53 which applies a limitation to the wall of the cavity represented by the outline 54 (i.e., the edge) of the opening. Because of its characteristic geometry, the edge 54 of the opening 53 defines, in addition to the form of the opening, a bevelled front face 55 and a rear face 56. The device according to the invention moreover presents any external form, capable of housing the cavity described previously. For example, it has an overall form of a cylinder of revolution, as in the illustration of FIG. 4, for example.

Concerning an object that allows a determined orientation of the tractor rope, the device according to the invention is also arranged so as to be able to be placed in proximity to the drum of the winch with a constant orientation enabling it to ensure its scale orientation function. To this end, it is designed to be able to receive a fixing arm 57, or any other similar means.

The turned position view of FIG. 6 shows the device according to the invention with the opening 53 directed upward. It thus shows the characteristic profile of the edge of the opening 53, and the bevelled profile of the front face 55.

According to the invention, the edge of the opening 53 can be defined as the meeting of two curved half-edges 61 and 62, the profiles of which follow two counter-rotational and coaxial helical curves, the axis of symmetry of which is the same as the axis 59 of the cavity. Each helical half-edge performs a rotation of around 180° from a point 63 of the edge of the opening common to both half-edges and situated at the level of the front face of the device.

The angle of rotation is in practice defined by the width of the profile of the scale in transverse cross-section, the scales, and therefore the rope on which they are mounted, being seen, as illustrated by FIG. 7, to enter into the device through its front face 55, presenting a widely spread opening, and to leave the device through its rear face presenting a narrower opening, oriented in the desired direction, of a form substantially identical to that of the surface 24 of the scale in transverse cross-section and of size substantially equal apart from a functional play. Beyond this angle of rotation, each half-edge is extended towards the rear of the device by a straight segment 510 or 511 defining a constant opening making it possible to guide the scale to its exit from the device.

Using such a device, it is therefore advantageously possible to automatically position a scale according to a possible orientation, regardless of the orientation taken by the latter on entering the device. As it moves through the device according to the invention, the scale, moved by the pulling force exerted on the rope to which it is joined translation-wise, is automatically guided rotation-wise from its original orientation to its final orientation which corresponds to the desired orientation.

FIG. 7 moreover shows the device according to the invention mounted on the distribution system 71 of the winch, a guidance system whose known role is to variably position the rope so that the latter forms tightly-adjacent turns occupying the entire surface of the drum after winding.

In a first simple embodiment, the device according to the invention is essentially characterized by the particular profile of the edge 54 of the opening 53, as described in the above. In this first embodiment, the form of the wall of the cavity 53 is not specifically imposed, provided that the dimensions of the cavity allow the scales to pass through, in other words, provided that the section of the cavity is sufficient over its entire length to allow the passage of a scale being presented by its section with any orientation. In such a configuration, the cavity can, for example, have the form of the cavity 52 defined by a cylinder of revolution, the axis of revolution of which is the same as the axis 59 and presenting an opening 53 with an edge 54 such as that defined previously. The only constraint attached to the production of this cavity lies in the fact that the internal diameter of the cylinder of revolution on which it is constructed be of a size slightly less than the height h of the scale. This way, the guidance of the scale from any orientation to the desired orientation is performed solely by the edge of the opening 53, an edge on which the scale bears via its free edge 22 (see FIG. 2) as it passes through the device, a passage that it performs under the action of the pulling force exerted by the rewinding of the rope. In the plainest version of this embodiment, the device according to the invention can even take the form of a rail in the form of a double helix on which the scale bears and which guides it to the desired orientation.

In a preferred embodiment, the device according to the invention is not reduced to a simple guidance rail, but, on the contrary, a solid object presenting a cavity 52, of which the internal wall is exploited. In this embodiment, the device presents an additional characteristic associated with the form of the wall limiting the cavity 52. According to this preferred embodiment, the wall of the cavity 52 is constructed by effecting an excavation of the material forming the device along an axis that is the same as the axis 59, the excavation being done by a sweep of the section of the device by a surface corresponding to the section of the scale 13, the angular opening of the sweep being defined for the section passing though a given point of the axis of symmetry 59 by the position of the half-edges 61 and 62 defining the opening 53 at the level of this point. In other words, the wall of the cavity, comprising the meeting of the two half-walls 64 and 65, is constructed by effecting an excavation of the material forming the device along an axis that is the same as the axis of symmetry 59 of the cavity 52, the excavation being done by a sweep of the section of the device by a surface corresponding to the section 24 of the scale 21, the angular opening of the sweep being defined, for the section passing through a given transverse plane, by the intersections of the half-edges 61 and 62 with this plane. This embodiment is illustrated by FIGS. 8 and 9-*a* to 9-*i*.

Figure 8:
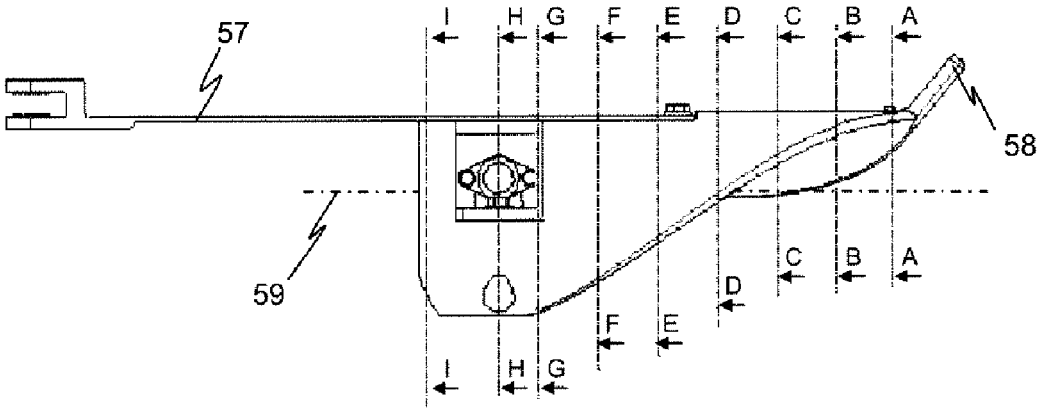
FIGS. 8 and 9-*a* to 9-*i*, illustrations of the principle of operation of the device according to the invention.
Figure 9:
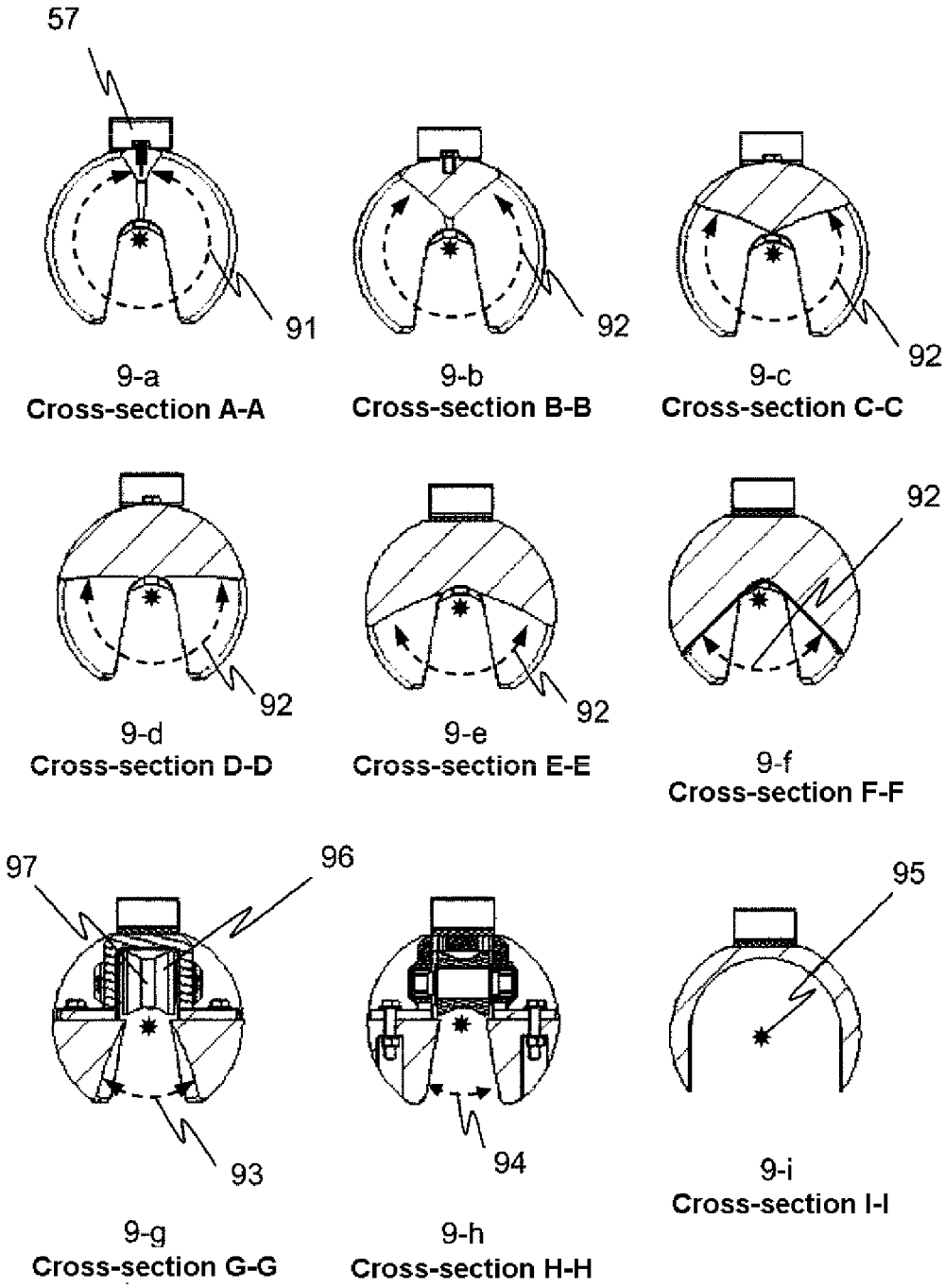

FIG. 8, in conjunction with FIGS. 9-*a* to 9-*i*, show the form of the excavation through transverse cross-sections at various points. FIGS. 9-*a* to 9-*i* respectively correspond to the cross-sections A-A to I-I mentioned in FIG. 8. The cross-section A-A substantially corresponds to a transverse view of the device from the front face (cross-section at the level of the point 63 of FIG. 6), whereas the cross-sections B-B to G-G correspond to intermediate cross-sections at points for which the surface of the wall of the cavity 52 is opened out, as described in the preceding section, following the helical profile of the edge 54 of the opening 53. The cavity is thus produced, in a known manner, by changing from an excavation effected on an angular opening 91 of 360° (cross-section A-A), by different intermediate opening values 92, to an excavation effected on an angular opening 93 that closely follows the transverse cross-sectional profile of the scale (cross-section G-G). Then, the cavity ends (cross-section H-H) in a final guidance duct 94 having substantially the form and the dimensions of the profile of the scale which opens out onto the rear face of the device (cross-section I-I).

In this preferred embodiment, the device according to the invention, although more complex to produce, presents the advantage of making it possible to assure the turning, and consequently bring in to the desired orientation, not only of the scales that are no longer linked rotation-wise to their neighbours but also those which, having been partially broken, no longer present a height h that is sufficient to allow them to bear on the edge 54 of the device to perform their reorientation. The guidance of such a scale is then provided by the internal wall of the cavity itself.

Whatever the embodiment envisaged, in particular the preferred embodiment described previously, the device according to the invention is designed and arranged relative to the winch so that the rope passes through it by being positioned substantially along the axis of symmetry 59, indicated by the asterisk 95 in FIGS. 9-*a* to 9-*i* and by a horizontal broken line in FIG. 8. To this end, the device according to the invention can comprise additional rope guidance means, placed in the area 66 where the rope 11 comes into contact with the wall of the cavity. In the configuration presented as a non-limiting example of embodiment, these additional means comprise a grooved rolling bearing 96. This rolling bearing is mounted on the rear part of the device, in an area situated behind the turning area of the scales (see cross-section drawings G-G to I-I). These means are furthermore arranged on the device so that, when the rope rests at the bottom of the groove 97 of the rolling bearing 96, the axis of the rope is the same, at least in the area of contact, as the axis of symmetry 59 of the device. This way, the rope can be positioned relative to a fixed point of reference of the device.

Whatever the embodiment envisaged, it is also possible to add to the device according to the invention means (see FIG. 5 or 6) making it possible to prevent a scale from being presented at the input of the device with an orientation in a direction bringing into direct contact the face 24 of the scale with the junction point 63 of the two half-edges 61 and 62 which constitutes the front point of the device. In practice, in such a case, however infrequent, the scale abuts on the end 63 of the device and because of this is incapable of sliding without stress along one or other of the half-edges to engage in the device. The means making it possible to overcome the consequences of such an eventuality have the characteristic of presenting to a scale located in the envisaged situation, a thin surface with rounded edges which, when it comes into contact with the top edge of the scale, imparts on the latter a slight rotation movement which prevents the front contact of the face 24 of the scale with the point 63 of the device.

As precisely illustrated by FIGS. 5 and 6, the means 58 can, for example, consist of a short rod in the form of a beak or spur of oval section positioned at the level of the point of the device (i.e. of the point 63) vertically or at a small angle from the vertical. However, any other object making it possible to separate the scale from the undesirable orientation before the latter engages in the device can be envisaged.

Figure 10:
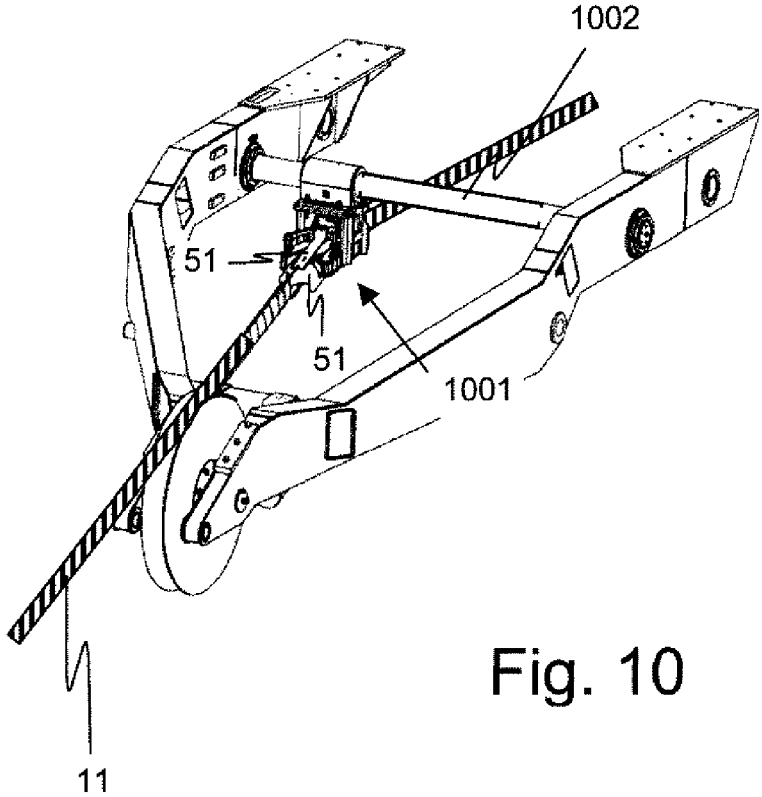
FIGS. 10 and 11, illustrations of an exemplary implementation of the device according to the invention on a winch distribution head.
Figure 11:
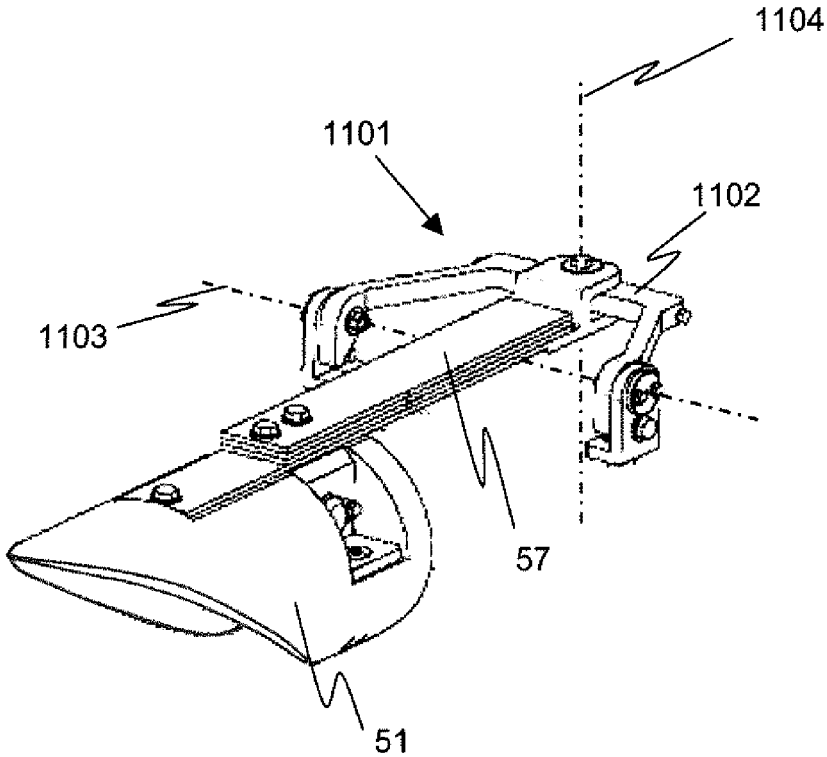

Consideration is now given to FIGS. 10 and 11.

FIG. 10 illustrates an exemplary implementation of the device according to the invention. In this application, the device according to the invention is mounted on the distribution system of the winch, on the drum of which the rope 12 is wound (represented without its scales in the figure). The distribution system comprises means of guiding the rope mounted on a carriage 1001 that moves along an axis 1002 parallel to the axis 15 of the drum of the winch. In this exemplary implementation, the scale turning device according to the invention is placed at the head of the distribution system, to which it is fixed via the fixing arm 57 described previously. The fixing arm takes the form of an elastic plate which here advantageously serves as a damper making it possible to control and limit the pressure force applied to the rope by the device according to the invention. Alternatively, it can also be of rigid structure, the damping then being provided by another means placed on the device according to the invention at the level of the point of contact of this device with the rope and associated, for example, with the groove rolling bearing 96. The two solutions can, moreover, naturally be combined in one and the same embodiment of the device.

In order to ensure correct operation of the assembly, regardless of the direction of orientation of the rope and the position of the distribution system on the axis 1002, the fixing arm of the device according to the invention, which on its own ensures the rotation of the device in a horizontal plane, is itself fixed to the distribution system by means also enabling the device according to the invention to follow the rotation movements in a vertical plane. Thus, whatever the stresses resulting from the distribution of the rope, the device according to the invention has a certain freedom of positioning which favours its optimum orientation with respect to the axis of the rope. These means can, for example, consist, as illustrated by FIG. 11, of a part 1101 comprising a horizontal central part 1102, on which is fixed the fixing arm 57 of the device according to the invention, and two lateral extensions arranged to enable an articulated fixing of the part 1101 to the moving carriage 1001, enabling the central part, and therefore the device according to the invention, to move rotation-wise about a horizontal axis 1103. The duly fixed device according to the invention 51 advantageously benefits from a mobility rotation-wise about a vertical axis 1104 and a horizontal axis 1103, a mobility that makes it possible to lessen all the mechanical stresses that can be imposed on it at a given instant because of its orientation relative to the axis of the rope.

The invention claimed is:

1. A device for ensuring an orientation in a fixed direction of an object threaded on a rope, moving rotation-wise about said rope and joined to said rope translation-wise, said object having the form of a cylinder of length L, presenting a transversal section of height H and comprising a longitudinal duct having the form of a cylinder of revolution, located at a level of its widest base, by which it is threaded onto the rope, said device comprising:

a rear face through which leaves the rope, a bevelled front face, through which enters the rope, and a cavity of a length at least equal to the length L of the object to be oriented, said cavity presenting an axis of symmetry and comprising an opening extending over its entire length, an edge of which is formed by two symmetrical half-edges, the profiles of which firstly follow two counter-rotational and coaxial helical curves, the axis of symmetry of which is the same as the axis of symmetry of the cavity, each helical half-edge performing a rotation of around 180° about the axis of symmetry from a point of the edge of the opening common to both half-edges and situated at a level of the front face of the device; there then follow two parallel straight segments spaced apart so that a width of the opening ensures the appropriately oriented guidance of the object-until the device is paid out by maintaining a desired orientation.

2. The device as claimed in claim 1, further comprising a fixing arm making it possible to position it so as to ensure the desired orientation of the object to be oriented after its passage into the device.

3. The device as claimed in claim 2, wherein the fixing arm is configured to enable a movement rotation-wise in a horizontal plane of the device.

4. The device as claimed in claim 3, wherein the fixing arm forms an elastic plate making it possible to control a pressure force exerted on the rope during its passage into the device.

5. The device as claimed in claim 1, further comprising means for imposing, on the object to be oriented, an input orientation avoiding contact of the object with a point of the front face of the device.

6. The device as claimed in claim 1, further comprising means for positioning the axis of the rope along the axis of symmetry of the cavity.

7. The device as claimed in claim 6, wherein the means for positioning the axis of the rope comprise a grooved rolling bearing arranged at a rear of the bevelled front face.

8. An application of the device according to claim 1 to the turning of scales forming a streamlining of a rope for pulling a submersible body by a ship, said device being implemented to ensure an automatic orientation of the scales of the rope in an orientation allowing the rope to be wound onto a drum of a winch.

9. The device as claimed in claim 1, wherein the cavity presents a wall constructed by effecting an excavation of material forming the device along an axis that is the same as the axis of symmetry of the cavity, the excavation being done by a sweep of the section of the device by a surface corresponding to the section, in transverse cross-section, of the object, the angular opening of the sweep being defined, for the section passing through a given transverse plane, by intersections of the half-edges with this plane.

10. The device as claimed in claim 9, further comprising means for limiting a pressure force exerted on the rope on its passage into the device, these means being placed where the rope comes into contact with the wall of the cavity.

11. A distribution system for a rope for pulling a submersible body by a ship, comprising a turning device according to claim 10, mounted at a head of the system via a fixing arm.

12. The rope distribution system as claimed in claim 11, wherein the turning device is fixed to the system by means making it possible to rotate the device in a vertical plane.

* * * * *